US005577943A

United States Patent [19]

Vickers et al.

[11] Patent Number: 5,577,943

[45] Date of Patent: Nov. 26, 1996

[54] METHOD FOR FABRICATING A FIELD EMISSION DEVICE HAVING BLACK MATRIX SOG AS AN INTERLEVEL DIELECTRIC

[75] Inventors: Kenneth G. Vickers, Whitesboro; Chi-Cheong Shen, Richardson; Bruce E. Gnade; Jules D. Levine, both of Dallas, all of Tex.

[73] Assignee: Texas Instruments Inc., Dallas, Tex.

[21] Appl. No.: 450,610

[22] Filed: May 25, 1995

[51] Int. Cl.[6] ..... H01J 9/227; H01J 9/20

[52] U.S. Cl. ..... 445/24; 445/52; 313/496

[58] Field of Search ..... 445/24, 35, 49, 445/52; 313/495, 496, 461

[56] References Cited

U.S. PATENT DOCUMENTS

| | | | |
|---|---|---|---|
| 3,743,879 | 7/1973 | Kupsky | 445/52 |
| 3,755,704 | 8/1973 | Spindt et al. | 313/309 |
| 3,906,285 | 9/1975 | Kobayakawa et al. | 313/496 |
| 4,098,939 | 7/1978 | Kuroda et al. | 428/201 |
| 4,140,941 | 2/1979 | Uemura | 313/495 |
| 4,303,917 | 12/1981 | Kishino et al. | 313/496 |
| 4,352,042 | 9/1982 | Lorenz et al. | 313/485 |
| 4,472,658 | 9/1984 | Morimoto et al. | 313/497 |
| 4,622,272 | 11/1986 | Wengert et al. | 428/690 |
| 4,757,234 | 7/1988 | Ikuta et al. | 313/496 |
| 4,837,097 | 6/1989 | Narang et al. | 430/5 |
| 4,857,799 | 8/1989 | Spindt et al. | 313/495 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |

FOREIGN PATENT DOCUMENTS

| | | | |
|---|---|---|---|
| 0349425 | 1/1990 | European Pat. Off. | 313/496 |

*Primary Examiner*—P. Austin Bradley
*Assistant Examiner*—Jeffrey T. Knapp
*Attorney, Agent, or Firm*—Rose Alyssa Keagy; W. James Brady; Richard L. Donaldson

[57] ABSTRACT

A method of fabricating an anode plate 80 for use in a field emission device. The method comprises the steps of providing a substantially transparent substrate 88 having spaced-apart, electrically conductive regions 50 on a surface thereof, then coating the anode plate with a substantially opaque material 86. The opaque material 86 is removed from the surface of the conductive regions 50 in the active area 58, and from selected areas 60 of the interconnect portion of the conductive regions 50. A first bus 52 is provided for electrically connecting a first series $\mathbf{50}_R$ of the conductive regions 50, a second bus 54 is provided for electrically connecting a second series $\mathbf{50}_G$ of the conductive regions 50, and a third bus 56 is provided for electrically connecting a third series $\mathbf{50}_B$ of the conductive regions 50. Luminescent material of a first color $\mathbf{84}_R$ is applied to the first series of conductive regions $\mathbf{50}_R$, luminescent material of a second color $\mathbf{84}_G$ is applied to the second series of conductive regions $\mathbf{50}_G$, and luminescent material of a third color $\mathbf{84}_B$ is applied to the third series of conductive regions $\mathbf{50}_B$.

15 Claims, 6 Drawing Sheets

FIG. 5
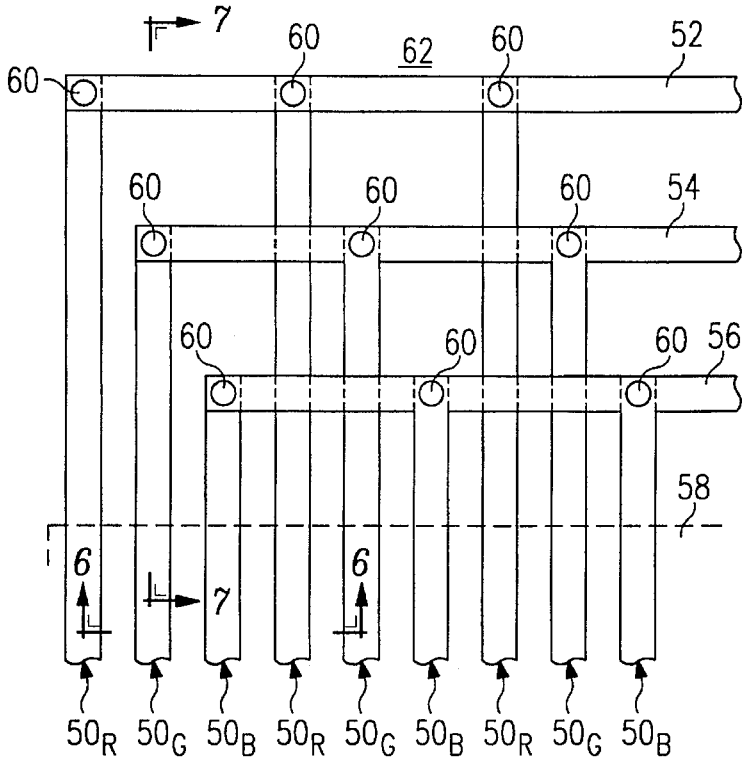
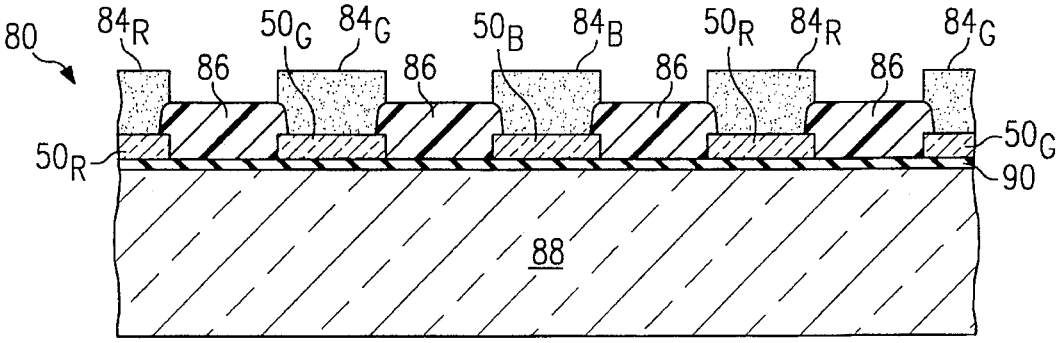
FIG. 6
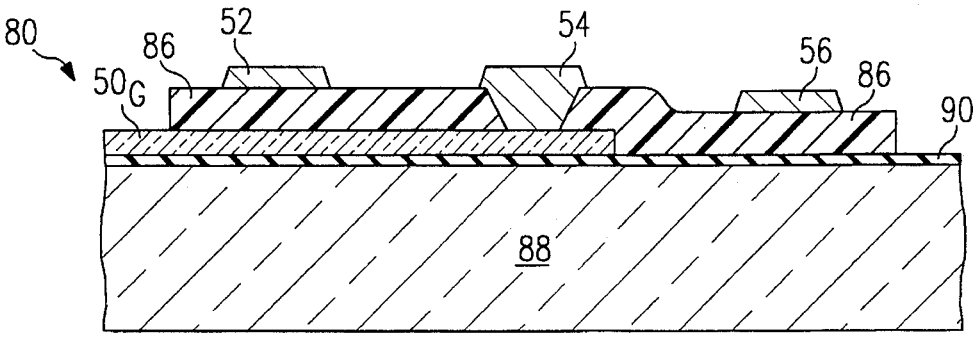
FIG. 7

METHOD FOR FABRICATING A FIELD EMISSION DEVICE HAVING BLACK MATRIX SOG AS AN INTERLEVEL DIELECTRIC

RELATED APPLICATION

This application includes subject matter which is related to U.S. patent application Ser. No. 08/450,051, "Black Matrix SOG As An Interlevel Dielectric In A Field Emission Device," (Texas Instruments, Docket No. TI-18446), filed even date. This application also includes subject matter which is related to U.S. patent application Ser. No, 08/247,951, "Opaque Insulator for Use on Anode Plate of Flat Panel Display," (Texas Instruments, Docket No. TI-18398), filed May 24, 1994, now abandoned.

TECHNICAL FIELD OF THE INVENTION

The present invention relates generally to flat panel displays and, more particularly, to a method for fabricating an anode plate of a flat panel display having an interlevel dielectric which reduces anode plate manufacturing steps.

BACKGROUND OF THE INVENTION

The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising. Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Fr éderic Clerc. These patents are incorporated by reference into the present application.

A FED flat panel display arrangement is disclosed in U.S. Pat. No. 4,857,799, "Matrix-Addressed Flat Panel Display," issued Aug. 15, 1989, to Charles A. Spindt et al., incorporated herein by reference. This arrangement includes a matrix array of individually addressable light generating means of the cathodoluminescent type having electron emitting cathodes combined with an anode which is a luminescing means of the CRT type which reacts to electron bombardment by emitting visible light. Each cathode is itself an array of thin film field emission cathodes on a backing plate, and the luminescing means is provided as a phosphor coating on a transparent face plate which is closely spaced to the cathodes.

The emitter backing plate disclosed in the Spindt et al. ('799) patent includes a large number of vertical conductive cathode electrodes which are mutually parallel and extend across the backing plate and are individually addressable. Each backing plate includes a multiplicity of spaced-apart electron emitting tips which project upwardly from the vertical cathode electrodes on the backing plate and therefore extend perpendicularly away from the backing plate. An electrically conductive gate electrode arrangement is positioned adjacent to the tips to generate and control the electron emission. The gate electrode arrangement comprises a large number of individually addressable, horizontal electrode stripes which are mutually parallel and extend along the backing plate orthogonal to the cathode electrodes, and which include apertures through which emitted electrons may pass. Each gate electrode is common to a full row of pixels extending across the front face of the backing plate and is electrically isolated from the arrangement of cathode electrodes. The emitter back plate and the anode face plate are parallel and spaced apart.

The anode is a transparent glass substrate covered with a thin film of an electrically conductive transparent material, such as indium tin oxide (ITO), which covers the interior surface of the anode face plate. Deposited onto this metal layer is a cathodoluminescent material, such as phosphor, that emits light when bombarded by electrons.

The array of emitting tips is activated by addressing the orthogonally related cathode gate electrodes in a generally conventional matrix-addressing scheme. The appropriate cathode electrodes of the display along a selected stripe, such as along one column, are energized while the remaining cathode electrodes are not energized. Gate electrodes of a selected stripe orthogonal to the selected cathode electrode are also energized while the remaining gate electrodes are not energized, with the result that the emitting tips of a pixel at the intersection of the selected cathode and gate electrodes will be simultaneously energized, emitting electrons so as to provide the desired pixel display.

The Spindt et al. patent teaches that it is preferable that an entire row of pixels be simultaneously energized, rather than energization of individual pixels. According to this scheme, sequential lines are energized to provide a display frame, as opposed to sequential energization of individual pixels in a raster scan manner.

The Clerc ('820) patent discloses a trichromatic field emission flat panel display having a first substrate comprising the cathode and gate electrodes, and having a second substrate facing the first, including regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

Today, a conventional FED is manufactured by combining the teachings of many practitioners, including the teachings of the Spindt et al. ('799) and Clerc ('820) patents. Referring initially to FIG. 1, there is shown, in cross-sectional view, a portion of an illustrative prior field emission device in which the present invention may be incorporated. This device comprises an anode plate 1 having a cathodoluminescent phosphor coating 3 facing an emitter plate 2, the phosphor coating 3 being observed from the side opposite to its excitation.

More specifically, the field emission device of FIG. 1 comprises an anode plate 1 and an electron emitter (or cathode) plate 2. A cathode portion of emitter plate 2 includes conductors 9 formed on an insulating substrate 10, an electrically resistive layer 8 which is formed on substrate 10 and overlaying the conductors 9, and a multiplicity of electrically conductive microtips 5 formed on the resistive layer 8. In this example, the conductors 9 comprise a mesh structure, and microtip emitters 5 are configured as a matrix within the mesh spacings. Microtips 5 take the shape of cones which are formed within apertures through conductive layer 6 and insulating layer 7.

A gate electrode comprises the layer of the electrically conductive material 6 which is deposited on the insulating layer 7. The thicknesses of gate electrode layer 6 and insulating layer 7 are chosen in such a way that the apex of each microtip 5 is substantially level with the electrically conductive gate electrode layer 6. Conductive layer 6 may be in the form of a continuous layer across the surface of substrate 10; alternatively, it may comprise conductive bands across the surface of substrate 10.

Anode plate 1 comprises a transparent, electrically conductive film 12 deposited on a transparent planar support 13, such as glass, which is positioned facing gate electrode 6 and parallel thereto, the conductive film 12 being deposited on the surface of the glass support 13 directly facing gate electrode 6. Conductive film 12 may be in the form of a continuous layer across the surface of the glass support 13; alternatively, it may be in the form of electrically isolated stripes comprising three series of parallel conductive bands across the surface of the glass support 13, as shown in FIG. 1 and as taught in U.S. Pat. No. 5,225,820, to Clerc. By way of example, a suitable material for use as conductive film 12 may be indium-tin-oxide (ITO), which is optically transparent and electrically conductive. Anode plate 1 also comprises a cathodoluminescent phosphor coating 3, deposited over conductive film 12 so as to be directly facing and immediately adjacent gate electrode 6. In the Clerc patent, the conductive bands of each series are covered with a particulate phosphor coating which luminesces in one of the three primary colors, red, blue and green $\mathbf{3}_R$, $\mathbf{3}_B$, $\mathbf{3}_G$.

Selected groupings of microtip emitters 5 of the above-described structure are energized by applying a negative potential to cathode electrode 9 relative to the gate electrode 6, via voltage supply 19, thereby inducing an electric field which draws electrons from the apexes of microtips 5. The potential between cathode electrode 9 and gate electrode 6 is approximately 70–100 volts. The emitted electrons are accelerated toward the anode plate 1 which is positively biased by the application of a substantially larger positive voltage from voltage supply 11 coupled between the cathode electrode 9 and conductive film 12 functioning as the anode electrode. The potential between cathode electrode 9 and anode electrode 12 is approximately 300–800 volts. Energy from the electrons attracted to the anode conductive film 12 is transferred to particles of the phosphor coating 3, resulting in luminescence. The electron charge is transferred from phosphor coating 3 to conductive film 12, completing the electrical circuit to voltage supply 11. The image created by the phosphor stripes is observed from the anode side which is opposite to the phosphor excitation, as indicated in FIG. 1.

It is to be noted and understood that true scaling information is not intended to be conveyed by the relative sizes and positioning of the elements of anode plate 1 and the elements of emitter plate 2 as depicted in FIG. 1. For example, in a typical FED shown in FIG. 1 there are approximately one hundred arrays 4, of microtips per display pixel, and there are three color stripes $\mathbf{3}_R$, $\mathbf{3}_B$, $\mathbf{3}_G$ per display pixel.

The process of producing each frame of a display using a typical trichromatic field emission display includes (1) applying an accelerating potential to the red anode stripes while sequentially addressing the gate electrodes (row lines) with the corresponding red video data for that frame applied to the cathode electrodes (column lines); (2) switching the accelerating potential to the green anode stripes while sequentially addressing the rows lines for a second time with the corresponding green video data for that frame applied to the column lines; and (3) switching the accelerating potential to the blue anode stripes while sequentially addressing the row lines for a third time with the corresponding blue video data for that frame applied to the column lines. This process is repeated for each display frame.

FIG. 2 is a block diagram of a portion of a field emission display electronics system as disclosed in U.S. patent application Ser. No. 08/332,182, "Field Emission Device Automatic Anode Voltage Adjuster," filed 31 Oct. 1994 (Texas Instruments, Docket No. TI-19620), incorporated herein by reference. As indicated in FIG. 2, anode plate 1 is physically located over emitter plate 2; however, anode plate 1 and emitter plate 2 are separated in the drawing in order to better show the elements comprising plates 1 and 2 of the FED display. Elements which are part of the system but which are unimportant to the understanding of the field emission display are not shown.

Anode power supply 20 provides a high voltage source to an anode switching control 22, typically between 300 and 800 volts. The anode voltage switching control 22, responsive to commands issued from data formatting and timing controller 24, provides voltages simultaneously (if the image is in monochrome) or sequentially (if the image is in color) to the three anode stripes $\mathbf{3}_R$, $\mathbf{3}_G$, and $\mathbf{3}_B$, each of the anode stripe voltages being set to a level in accordance with the brightness characteristics of the corresponding luminescent material.

The cathode electrodes 9 (column lines) of matrix-addressable cathode emitter plate 2 are individually coupled to column drivers 26. The column drivers 26 receive video data from a host device, which has been formatted by the data formatter and timing controller 24 into separate red, green, and blue display frames from an original mixed signal. In this example, the data formatter and timing controller 24 may process the video data according to the VGA standard, and may typically output data to the column drivers 26 for output on 640 parallel lines, to thereby provide one color component of a single row of the display. The data from the data formatter and timing controller 24 is latched into the column drivers 26 upon each occurrence of a clock signal received at the clock input terminal CLK.

The gate electrodes 6 (row lines) of matrix-addressable cathode plate 2 are individually coupled to row drivers 28. The row drivers 28 receive enable signals from row address counter/decoder 30. The device 30 includes a counter which is responsive to each occurrence of a clock signal received at a CLK input terminal, and a decoder which applies an enabling signal sequentially to each of the row drivers 28. In this example, the counter of the device 30 may count to 480, the decoder portion of the device 30 applying enabling signals sequentially to each of the row drivers 28, to thereby address each of the 480 output lines.

The data formatter and timing controller 24 also receives a synchronization input signal from the host. The sync input contains the clock, horizontal sync, and vertical sync information.

The data formatter and timing controller 24 is coupled to frame memory 32. The memory 32 holds the luminance information corresponding to two red pixels, two green pixels and two blue pixels. For illustration purposes, memory 32 comprises 307,200 words of 12-bit length, which is the capacity necessary to store two full frames of six bits of luminance information for each pixel of a 640-column by 480-row display system.

In accordance with a field sequential mode of operation, an entire frame of red luminance information is first clocked out of the memory 32. After an entire frame of red luminance information has been transferred from the memory 32 a similar process is repeated for an entire frame of green luminance information, and thereafter for an entire frame of blue luminance information. This entire process is repeated continuously while an image is displayed by the FED. The eye is a slow detector compared with the frame time and the perception of the full color is due to an averaging effect over several image frames. Therefore, the color sensation perceived by a person viewing the FED is due to a reconstitution of the colored spectrum by the viewer's eye.

As indicated in FIG. 2, all red stripes $\mathbf{3}_R$ are electrically coupled together. All green stripes $\mathbf{3}_G$ and all blue stripes $\mathbf{3}_B$ are also electrically coupled to each other. The prior art structure used to facilitate the electrical interconnection of the color anode stripes $\mathbf{3}_R$, $\mathbf{3}_G$, and $\mathbf{3}_B$, is shown in FIGS. 3 and 4 and disclosed in the Clerc ('820) patent. FIG. 3 shows the manner in which the conductive film 34 of the anode stripes 34 are interconnected in the prior art. The conductive films 34 are substantially similar to the conductive film 12 of FIG. 1. Conductive film $\mathbf{34}_R$ is covered with a phosphor coating luminescing in red, conductive film $\mathbf{34}_R$ is covered with a phosphor coating luminescing in blue, and conductive film $\mathbf{34}_G$ is covered with a phosphor coating luminescing in green.

The conductive films $\mathbf{34}_R$ are electrically interconnected by a first conductive band 36. The conductive films $\mathbf{34}_G$ are electrically interconnected by a second conductive band 38. The conductive films $\mathbf{34}_B$ are electrically interconnected by a anisotropic conductive ribbon 40 described more fully below. The first and second conductive bands 36, 38 are formed on the anode plate 1 at the same time the conductive films 34 are formed. The conductive bands 36, 38 and the conductive films 34 are also coplanar and both are comprised of the same conductive material, illustratively indium-tin-oxide (ITO).

The conductive films $\mathbf{34}_R$ which are connected to band 36 are interdigitated with the conductive films $\mathbf{34}_G$ which are connected to band 38 and the conductive films $\mathbf{34}_B$ which are connected to band 40. The anisotropic conductive ribbon 40 is deposited perpendicular to the conductive films 34.

FIG. 4 shows a section of the anode plate 1 along the anisotropic conductive ribbon 40. The anisotropic ribbon 40 is essentially formed by a conductive strip 40" and a film 40'. The film 40' comprises carbide balls 42 distributed in an insulating binder forming the film 40', so as not to conduct electricity. As can be seen from FIG. 4, the conductive strip 40" crushes the film 40' at the conductive films $\mathbf{34}_B$. The density of the balls 42 is such that at the crushed points the balls 42 are in contact. The ribbon 40 becomes conductive at these points. The conductive films $\mathbf{34}_B$ are electrically connected to the conductive ribbon 40", but the non-crushed locations of film 40' are insulating.

There are numerous disadvantages to the prior art structure used to interconnect the red, green, and blue anode stripes. First, the use of the externally attached anisotropic ribbon 40 to connect the conductive films $\mathbf{34}_B$ creates a significant FED system reliability problem. If the ribbon 40 isn't assembled to anode plate 1 properly then the conductive films 34 of two or three colors will be shorted together. Furthermore, the ribbon 40 can become disconnected from the conductive films $\mathbf{34}_B$, causing non-luminescing lines to appear in the display image at the places where the conductive films $\mathbf{34}_B$ are not electrically interconnected to the ribbon 40.

What is needed is a multi-level metal structure which eliminates the need for the mechanically attached external ribbon. More ideally, what is needed is a multi-level anode plate structure which reduces the number of manufacturing steps by eliminating the need for a separate interlevel dielectric deposition process.

SUMMARY OF THE INVENTION

In accordance with the principles of the present invention, there is disclosed herein a method of fabricating an anode plate for use in a field emission device. The method comprises the steps of providing a substantially transparent substrate having spaced-apart, electrically conductive regions on a surface thereof, then coating the anode plate with a substantially opaque material. The opaque material is removed from the surface of the conductive regions in the active area, and from selected areas of the interconnect portion of the conductive regions. A first bus is provided for electrically connecting a first series of the conductive regions, a second bus is provided for electrically connecting a second series of the conductive regions, and a third bus is provided for electrically connecting a third series of the conductive regions. Luminescent material of a first color is applied to the first series of conductive regions, luminescent material of a second color is applied to the second series of conductive regions, and luminescent material of a third color is applied to the third series of conductive regions.

The methods disclosed herein overcome limitations and disadvantages of the prior art display devices and methods. The opaque, electrically insulating material of the present invention fills in the gaps between the stripe conductors of the anode, thereby acting as a barrier to the entry of ambient light into the device, and further preventing the re-emergence of light reflected from the active surface of emitter plate. In addition, by virtue of its electrical insulating quality, the opaque material serves to increase the electrical isolation of the stripe conductor from one another, thereby permitting the use of higher anode potentials without the risk of breakdown due to increased leakage current.

The use of an insulating material separating the stripe conductors of the anode also provides the advantage of improving the definition of the phosphor depositions. Finally, it is noted that the improved insulating qualities of the structure of the present invention will allow the use of narrower spacings between the stripe conductors of the anode, thereby allowing increased anode stripe widths and increasing the area coated by the phosphors. This increased phosphor area reduces the density of the electrons impinging on the phosphor, thereby improving the phosphor efficiency.

The use of Double Level Metal (DLM) technology, as disclosed herein improves the anode plate reliability by eliminating the use of the mechanically attached external bus strip. The use of the opaque insulator as the interlevel dielectric in the bus region provides the advantage of reducing the cost of the anode plate by eliminating the need for an extra manufacturing step to deposit the dielectric for the DLM bus structure. Hence, for the application to flat panel display devices envisioned herein, the approaches in accordance with the present invention provide significant advantages.

BRIEF DESCRIPTION OF THE DRAWING

The foregoing features of the present invention may be more fully understood from the following detailed description, read in conjunction with the accompanying drawings, wherein:

FIG. 5 is a top view of an arrangement of the conductive stripes and buses of the anode plate using double level metal techniques in accordance with the present invention.

FIG. 6 is a cross-sectional view of an anode stripe region of the anode plate in accordance with the present invention.

FIG. 7 is a cross-sectional view of a bus region of an anode plate in accordance with the present invention.

DETAILED DESCRIPTION

Figure 1:
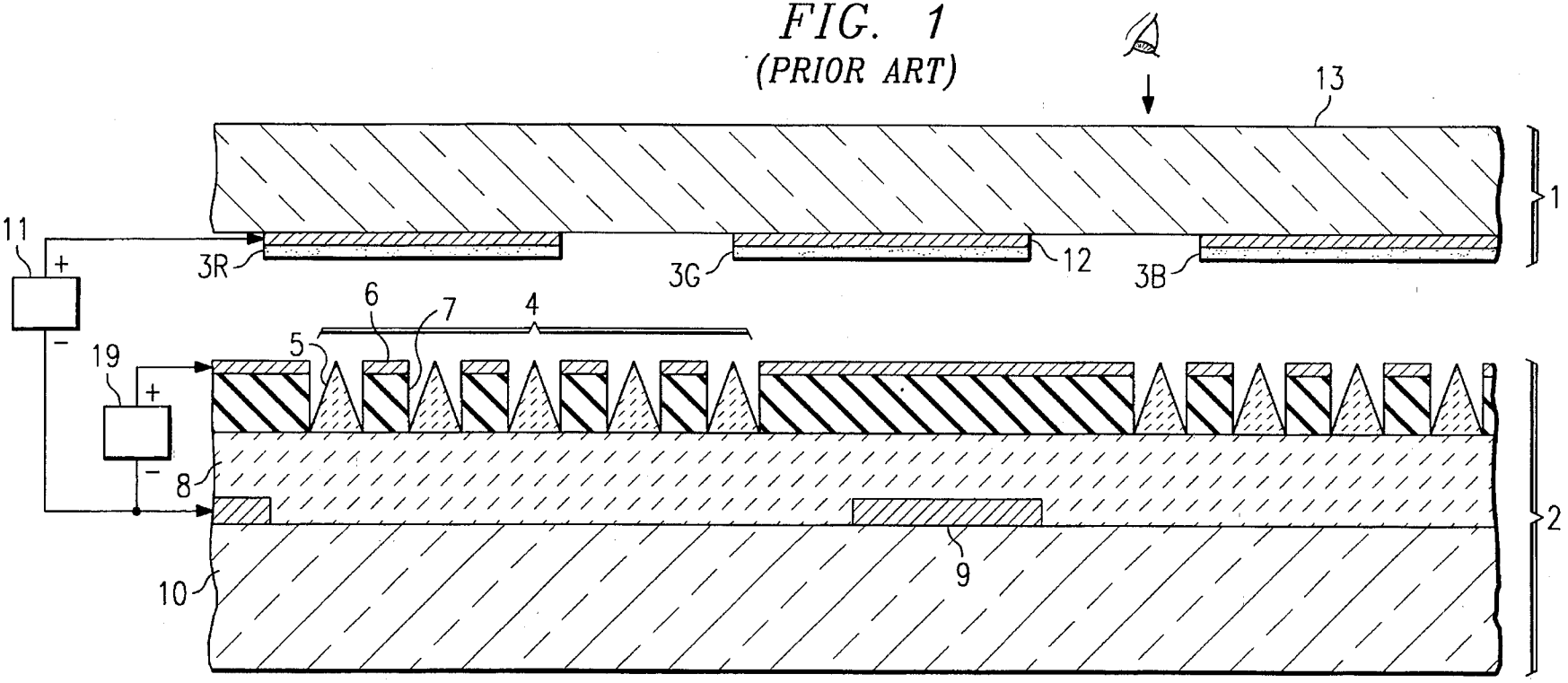
FIG. 1 (PRIOR ART)
FIG. 1 is a cross-sectional view of a portion of a field emission device according to the prior art.
Figure 2:
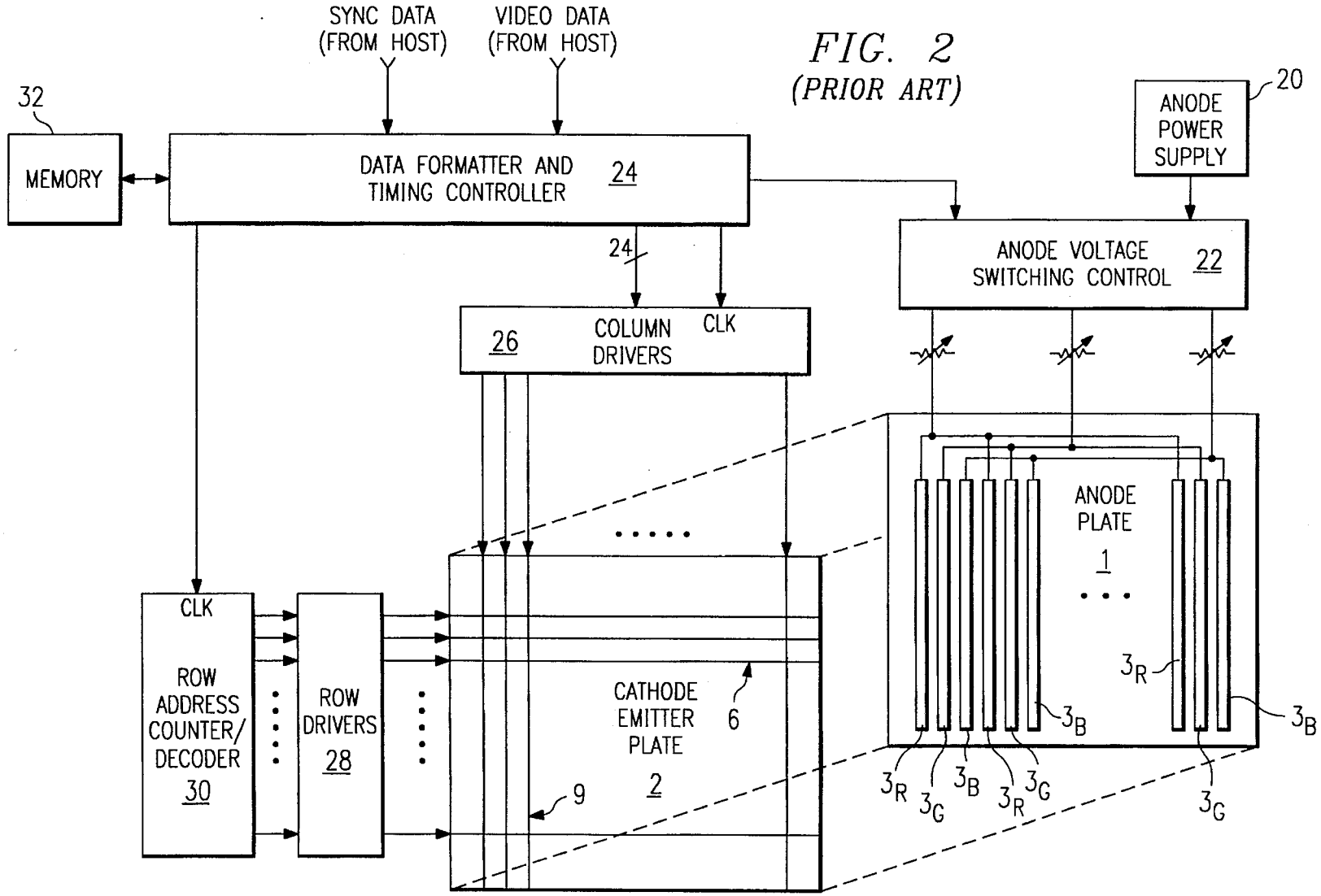
FIG. 2 (PRIOR ART)
FIG. 2 is a block diagram of a portion of a field emission display electronics system according to the prior art.
Figure 3:
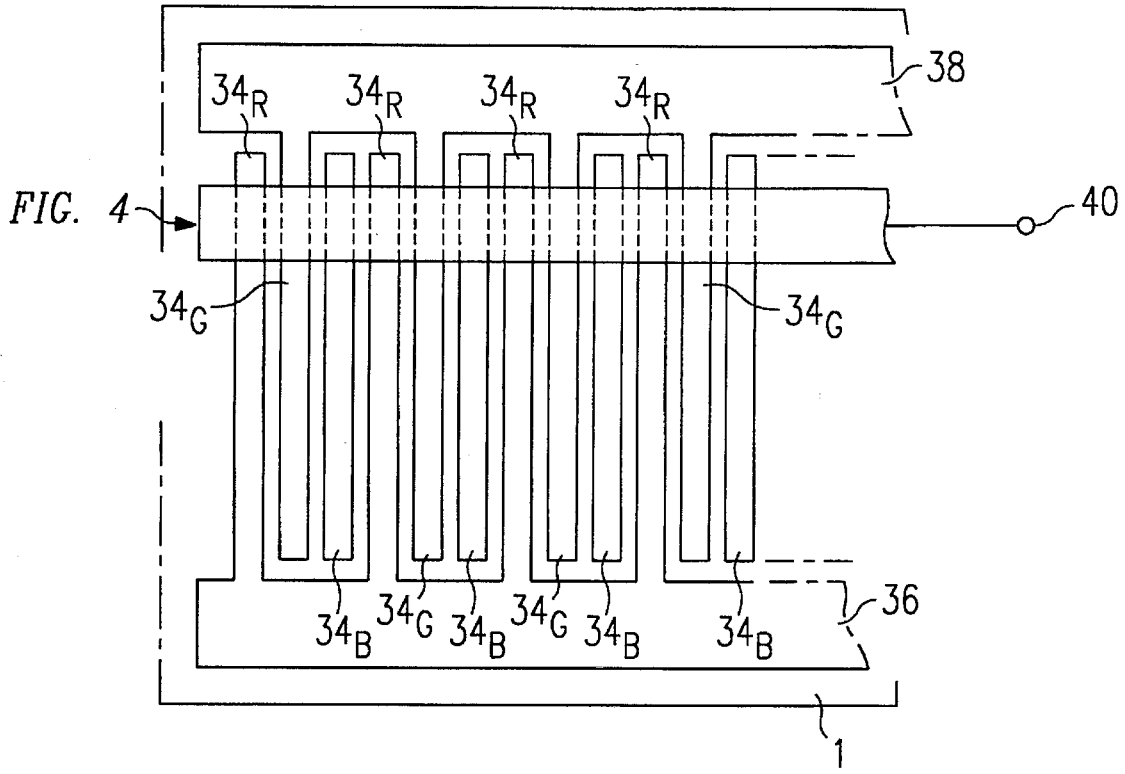
FIG. 3 (PRIOR ART)
FIG. 3 is a top view of the arrangement of conductive bands according to the prior art.
Figure 4:
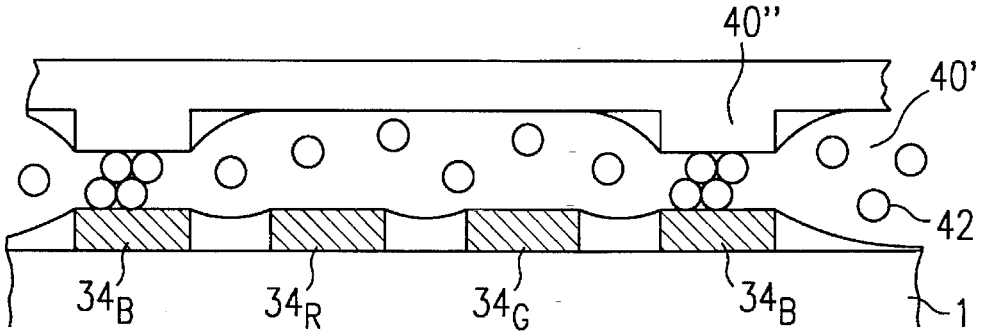
FIG. 4 (PRIOR ART)
FIG. 4 is a cross-sectional view of a conductive band of FIG. 3 according to the prior art.

One technique for improving the reliability of the anode plate by eliminating the use of the externally attached ribbon is to design the anode plate using Double Level Metal (DLM) techniques. FIG. 5 is a top view of an arrangement of the conductive stripes and buses of the anode plate using double level metal techniques. As shown in FIG. 5, all red anode stripes $\mathbf{50}_R$ are electrically interconnected to the red color bus 52, all green anode stripes $\mathbf{50}_G$ are electrically interconnected to the green color bus 54, and all blue anode stripes $\mathbf{50}_B$ are electrically interconnected to the blue color bus 56.

The anode plate of the present invention is designed such that the conductors 50 do not extend beyond their respective buses. The purpose of this design is to minimize the number of regions in the anode plate DLM bus structure where a bus of one color must cross an anode stripe of another color. For example, red bus 52 does not cross any green or blue anode stripes $\mathbf{50}_G$ or $\mathbf{50}_B$, and green bus 54 only crosses the red anode stripes $\mathbf{50}_R$. In each cross-over region a bus metal (for example 54) crosses an anode stripe 50 which is connected to a different bus (for example $\mathbf{50}_R$) and the two metal layers are separated only by an insulator layer. If a defect exists in the insulator layer, then a bus of one color will electrically short to an anode stripe of another color. When a bus of a first color shorts to an anode stripe of a second color then color distortion occurs as the phosphors of the second material are energized and therefore illuminate during the time that the phosphors of the first color are illuminated.

Using the structure shown in FIG. 5 for the FED anode plate design, the anode stripes 50 would be typically 80 microns wide. Since the application requires 80 microns wide anode stripes, the layout engineer would typically make the width of the buses 52, 54, and 56 approximately 80 microns wide also. This bus width would be chosen because it would be easy to design and because it easily accommodates the current and voltage drop requirements of the anode plate design. Furthermore, a bus width of 80 microns would be selected because the layout engineer would not want to make the bus width smaller than the anode stripe width and thereby unnecessarily restrict the diameter of the via 60. However, larger and smaller bus widths are considered to be within the scope of this invention.

The region in which the charged electrons from the cathode plate impinge on the anode stripes, thereby energizing the color phosphors and creating the color display image, is called the active display, or image-forming, region 58. The buses 52, 54, and 56, as well as the interconnections between the buses and the anode stripes 50 occur in the interconnect region 62 outside the active area 58.

The anode stripes 50 are interconnected to the buses 52, 54, and 56 through vias 60 using the DLM structure described in more detail below. Because every red, green, and blue anode stripe $\mathbf{50}_R$, $\mathbf{50}_G$, $\mathbf{50}_B$ is connected to its respective red, green and blue bus 52, 54, 56, FIG. 5 illustrates only a representative portion of the total anode plate structure.

Referring now to FIG. 6, there is shown a cross-sectional view across multiple anode stripes in the image-forming region 58 of anode plate 80, as indicated in FIG. 5. Anode plate 80 comprises a transparent planar substrate 88 having a layer 90 of an insulating material, illustratively silicon dioxide ($SiO_2$). A plurality of electrically conductive regions 50 are patterned on insulating layer 90. Conductive regions $\mathbf{50}_R$, $\mathbf{50}_G$, $\mathbf{50}_B$, referred to collectively as conductors 50, comprise the anode electrode of the field emission flat panel display device of the present invention. Luminescent material $\mathbf{84}_R$, $\mathbf{84}_G$ and $\mathbf{84}_B$, referred to collectively as luminescent material 84, overlays conductors 50. Finally, a substantially opaque, electrically insulating material 86 is affixed to substrate 88 in the spaces between conductors 50. It can be seen that opaque material 86 fills in the gaps between conductive regions 50, thereby acting as a barrier to the entry of ambient light into the device, and further preventing the reemergence of ambient light which is reflected from the active surface of emitter plate 2 (of FIG. 1). In addition, by virtue of its electrical insulating quality, opaque material 86 serves to increase the electrical isolation of conductive regions 50 from one another, thereby permitting the use of higher anode potentials without the risk of breakdown due to increased leakage current.

For purposes of this disclosure, as well as in the claims which follow, the term "transparent" shall refer to a high degree of optical transmissivity in the visible range. Furthermore, the term "opaque" shall refer to a very low degree of optical transmissivity in the visible range (the region of the electromagnetic spectrum between approximately 4,000–8,000Å).

In the present example, substrate 88 comprises glass. Also in this example, conductive regions 50 comprise a plurality of parallel anode stripe conductors which extend normal to the plane of the drawing sheet. A suitable material for use as anode stripe conductors 50 may be indium-tin-oxide (ITO), which is optically transparent and electrically conductive. In this example, luminescent material 84 comprises a particulate phosphor coating which luminesces in one of the three primary colors, red $\mathbf{84}_R$, green $\mathbf{84}_G$ and blue $\mathbf{84}_B$. A preferred process for applying phosphor coatings 84 to stripe conductors 50 comprises electrophoretic deposition.

No true scaling information is intended to be conveyed by the relative sizes of the elements of FIG. 6. By way of illustration, stripe conductors 50 may be 80 microns in width, and spaced from one another by 30 microns. The thickness of conductors 50 may be approximately 1,500Å, and the thickness of phosphor coatings 84 may be approximately 5–10 microns.

According to the present invention, the substantially opaque, electrically insulating material 86 preferably comprises glass having impurities dispersed therein, wherein the impurities may include one or more organic dyes, the combination of dyes being selected to provide relatively uniform opacity over the visible range of the electromagnetic spectrum. Alternatively, the impurities may include an oxide of a transition metal, the transition metal being chosen from among those which form black oxides. In the latter case, the metallic oxide particles must be sufficiently dispersed within the glass such that material 86 retains a high degree of electrical insulating quality. In the present invention, the average thickness of material 86 may be on the order of 15,000Å.

Opaque, electrically insulating material 86 is preferably formed from a solution of tetraethylorthosilicate (TEOS), which is sold by, for example, Allied Signal Corp., of Morristown, N.J. The solution of TEOS, including a solvent which may comprise ethyl alcohol, acetone, N-butyl alcohol and water, is commonly referred to as "spin-on-glass" (SOG). The TEOS and solvents are combined in proportions according the desired viscosity of the spin-on-glass solution. TEOS provides the advantages that it cures at a relatively low temperature and, when fully cured, all of the solvent and most of the organic materials have been driven out, leaving primarily glass ($SiO_x$). The TEOS solution may be spun on the surface of anode plate 80, or it may be spread on the surface, using techniques which are well known in the manufacture of, for example, liquid crystal display devices.

The impurities which produce the opacity of material 86 fall into two general categories, organic dyes and metallic oxides. Organic dyes are advantageous in that they disperse readily and uniformly throughout the TEOS solution, without diminishing its insulating quality, but they are limited in the temperature range to which they can be exposed, typically to less than 200° C.

The following example illustrates a formulation of material 86 including an organic dye. Either a single dye, such as Sudan Black, or a mixture of dyes, is added at a typical concentration of 13 mg of dye/ml of the solution of TEOS and solvents. The transmissivity of this mixture is less than fifty percent over the range which includes the spectrum of visible light.

The second category of impurities which produce the opacity of material 86 comprises metallic oxides or rare earth. Compounds of transition metals which are soluble in the TEOS solution provide sources of metallic ions which may form dark, preferably black, oxides during the TEOS curing process. Such compounds may include, but are not limited to, nitrates, sulfates, hydroxides, acetates and other metal organic compounds of the transition metals. Transition metals which form black oxides include, but are not limited to, cobalt and copper. In most cases, the transition metal ion is converted to the metal oxide during the curing cycle. Alternatively, the metal oxides may be directly dispensed in the TEOS if the metal oxides particles are small enough (i.e. less than 1 micron) and thoroughly dispersed.

The following example illustrates a formulation of material 86 including a compound of a transition metal. Cobalt nitrate ($Co(NO_3)_2$) is added to a solution of TEOS and solvent, comprising alcohol and acetone, in the amount of 375 mg/ml. This combination also includes 0.5 ml of 1-butanol per ml of the TEOS solution to improve the uniformity of the mixture. The transmissivity of this mixture is approximately three percent over the range which includes the spectrum of visible light. As is the case for organic dyes, a plurality of different metal ion solutions, each of which is opaque over a portion of the visible spectrum, can be combined to minimize the optical transmission over the entire range from 4,000–8,000Å.

Referring now to FIG. 7, there is shown a cross-sectional view of an anode plate 80 along one anode stripe $\mathbf{50}_G$ and across buses 52, 54, and 56, as indicated in FIG. 5. Anode plate 80 comprises a transparent planar substrate 88 having a layer 90 of an insulating material, illustratively silicon dioxide ($SiO_2$). A plurality of electrically conductive anode stripe regions 50 is patterned on insulating layer 90, however only one anode stripe, namely $\mathbf{50}_G$ is shown. A substantially opaque, electrically insulating material 86 is affixed to substrate 88 over the conductors 50. The opaque material 86 is removed over conductor $\mathbf{50}_G$, thereby creating a via through insulating material 86 which exposes the surface of conductor $\mathbf{50}_G$. Finally, bus conductors 52, 54, 56 are patterned on the opaque material 86. As shown in FIG. 7 the via created in the opaque insulator 86 allows the green color bus 54 to be connected to the green color anode stripe $\mathbf{50}_G$.

In the present example, substrate 88 comprises glass, and insulator 90 comprises $SiO_2$. A suitable material for use as anode stripe conductors 50, which extend parallel to the plane of the drawing sheet, may be indium-tin-oxide (ITO), which is optically transparent and electrically conductive.

According to the present invention, the substantially opaque, electrically insulating material 86 preferably comprises glass having impurities dispersed therein, wherein the impurities may include one or more organic dyes, the combination of dyes being selected to provide relatively uniform opacity over the visible range of the electromagnetic spectrum. Alternatively, the impurities may include an oxide of a transition metal, the transition metal being chosen from among those which form black oxides. In the latter case, the metallic oxide particles must be sufficiently dispersed within the glass such that material 86 retains a high degree of electrical insulating quality. In the present invention, the average thickness of material 86 may be on the order of 15,000Å.

In the present example, bus conductors 52, 54, and 54 extend normal to the plane of the drawing sheet. A suitable material for use as bus conductors 52, 54, and 56 may be Al:2%Cu of a thickness of approximately 10,000Å.

It is to be noted and understood that true scaling information is not intended to be conveyed by the relative sizes of the elements of FIG. 7. As stated above, the thickness of anode stripe conductors 50 may be approximately 1,500Å. The thickness of the bus conductors 52, 54, and 56 may also be approximately 10,000Å. The opaque insulating material 86 may extend from the edge of the active region 58 to just beyond the edge of anode stripe $\mathbf{50}_R$. The thickness of opaque insulating material 86 may be 15,000Å. Bus conductors 52, 54, and 56 may be 80 microns in width, and spaced from one another by 80 microns. As previously stated, this bus size would be chosen because it would be easy to design and because it easily accommodates the current and voltage drop requirements of the buses. Furthermore, a bus width of 80 microns would be selected because the layout engineer would not want to make the bus width smaller than the anode stripe width and thereby unnecessarily restrict the diameter of via 60.

A typical method for manufacturing the anode plate in accordance with the present invention is as follows. FIGS.

Figure 8A:
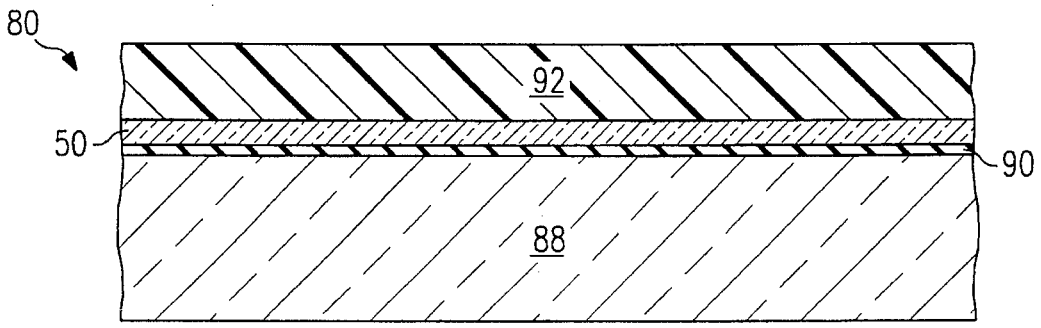
FIGS. 8A through 8B illustrate two sections of the anode plate at a first processing stage in accordance with the present invention.
Figure 8B:
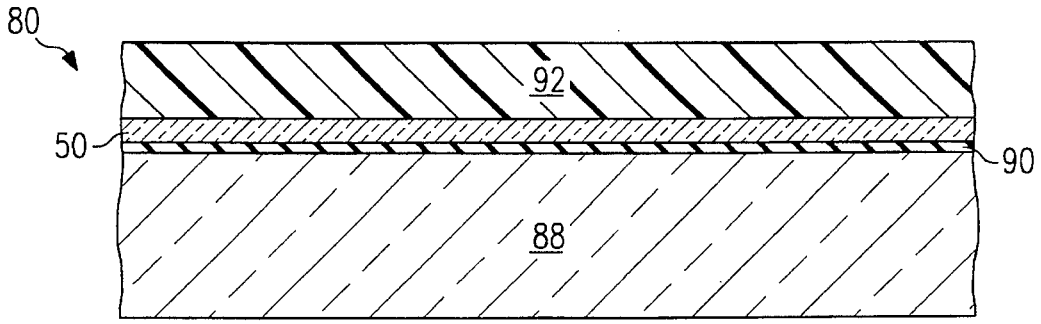

8A, 9A, 10A, and 11A illustrate the structure of FIG. 6 during selected stages of the manufacturing process. Similarly, FIGS. 8B, 9B, 10B, and 11B illustrate the structure of FIG. 7 during the same stages of the manufacturing process. Referring initially to FIGS. 8A and 8B, the glass anode face plate 88 is purchased with an insulating layer 90 of $SiO_2$ which is 500Å thick and a layer of ITO 50 which is 1500Å thick. A layer of photoresist 92, illustratively type AZ-1350J sold by Hoescht-Celanese of Somerville, N.J., is spun on over the ITO layer to a thickness of approximately 10,000Å. Next, a patterned mask (not shown) is disposed over the light-sensitive photoresist layer. The mask exposes desired regions of the photoresist to light. The mask used in this step defines anode stripes 50 which have a width of approximately 80 microns. The exposed regions are removed during the developing step, which may consist of soaking the assembly in a caustic or basic chemical such as Hoescht-Celanese AZ developer. The developer removes the unwanted photoresist regions which were exposed to light.

Figure 9A:
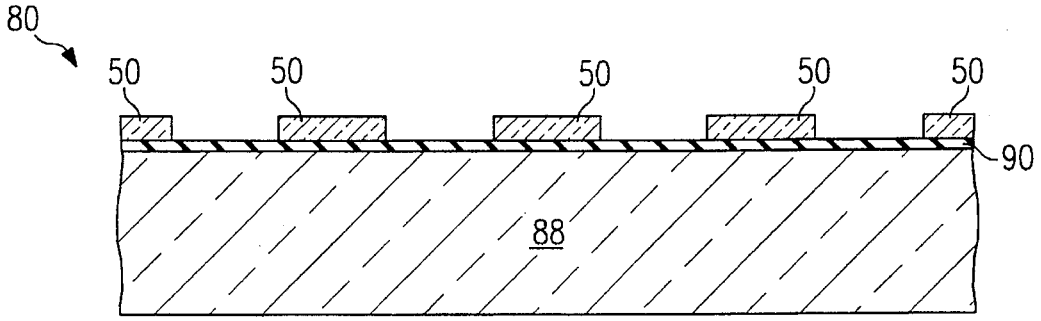
FIGS. 9A through 9B illustrate two sections of the anode plate at a second processing stage in accordance with the present invention.
Figure 9B:
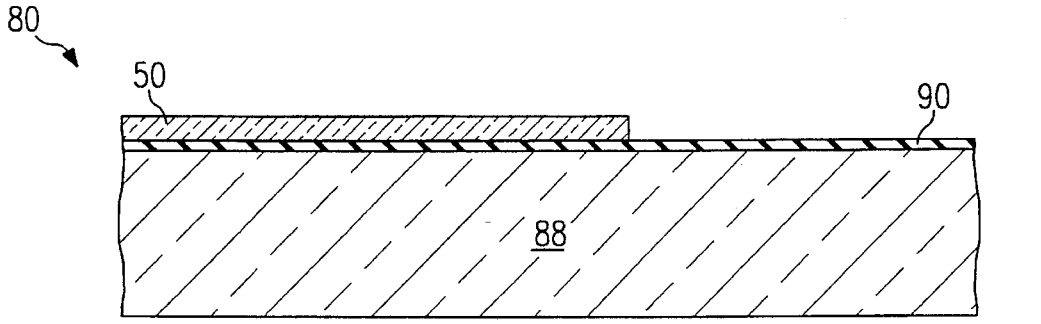

The exposed regions of the ITO layer are then removed, typically by a wet etch process using hydrochloric acid (HCl) and ferric chloride ($FeCl_3$). Although not shown as part of this process, it may also be desired to remove $SiO_2$ layer 90 underlying the etched-away regions of the ITO layer 50. The remaining photoresist layer is removed by a wet strip process using commercial organic strippers or plasma ashing, leaving the structures shown in FIGS. 9A and 9B. The portions of ITO which remain on anode plate 88 are the substantially parallel anode stripes 50.

A coating 86 of spin-on-glass (SOG) including impurities which provide opacity, which may be of a type described earlier, is applied over the striped regions of layer 50 and the exposed portion of layer 90, typically to an average thickness of approximately 15,000Å above the surface of insulating layer 90. The thickness of the coating 86 is chosen such that there is sufficient electrical isolation between the conductors 50 and the bus conductors 52, 54, and 56. The method of application may comprise dispensing the SOG mixture onto the assembly while substrate 88 is being spun, thereby dispersing SOG coating 86 relatively uniformly over the surface and tending to accelerate the drying of the SOG solvent. Alternatively, the SOG mixture may be uniformly spread over the surface. The SOG is then precured at 100° C. for about fifteen minutes, and then fully cured by heating it until virtually all of the solvent and organics have been driven off, typically at a temperature of 300° C. for approximately four hours.

Alternatively, the SOG coating 86 may be applied and cured in two or more consecutive thin layers, which together create a total thickness of 15,000Å. In situations where the coating 86 is applied in multiple layers, some of the layers may be undoped (i.e. no opaque material), thereby increasing the resistivity of the material in the normal direction. The thickness of the SOG coating 86 may be increased to 25,000Å in high voltage applications, such as that disclosed in U.S. patent application Ser. No. 08/399,673, "A Field Emission Device As A Backlighting Source for Liquid Crystal Displays," filed Mar. 7, 1995 (Texas Instruments, Docket No. TI-20078), incorporated herein by reference.

Figure 10A:
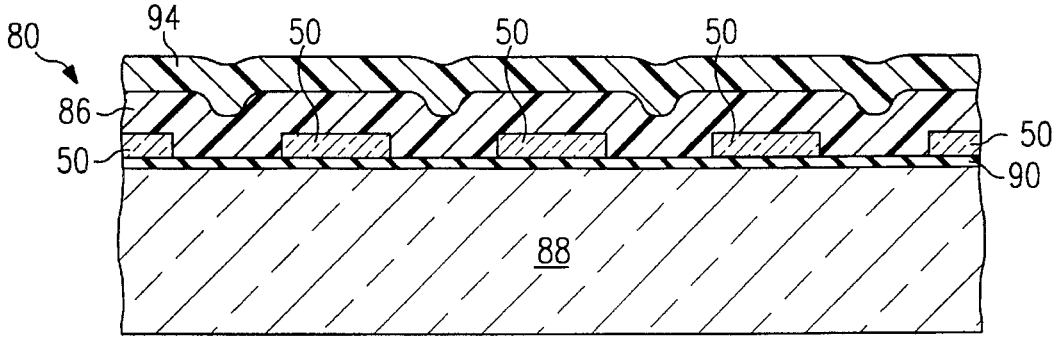
FIGS. 10A through 10B illustrate two sections of the anode plate at a third processing stage in accordance with the present invention.
Figure 10B:
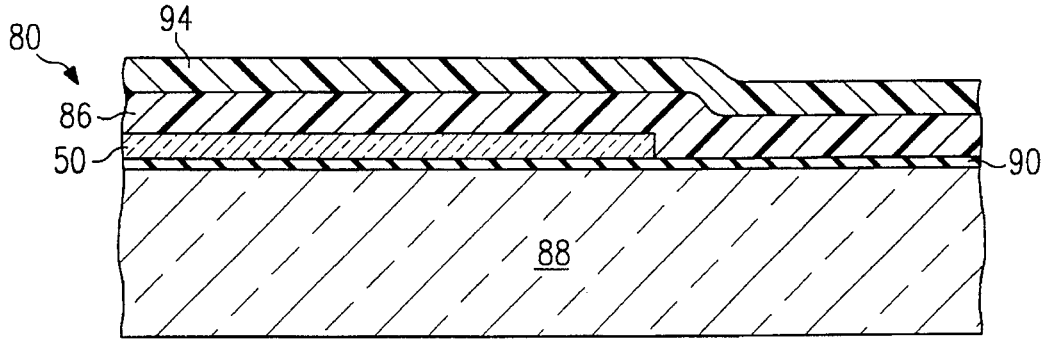

A second coating of photoresist 94, which may be of the same type used as layer 92, is deposited over the cured SOG, typically to a thickness of 10,000Å, as illustrated in FIGS. 10A and 10B. A second patterned mask (not shown) is disposed over layer 94 exposing regions of the photoresist which, in the case of this illustrative positive photoresist, are to be removed during the developing step. Specifically, photoresist will be removed in FIG. 10A in these regions lying directly over the spaces between the stripes of layer 50. In FIG. 10B the photoresist will be removed over the via region of conductive layer 50 and also over the region which extends outside the longest conductive layers 50. The exposed, unwanted regions of the photoresist are removed during a development step using AZ-developer. The exposed regions of SOG layer 86 are then removed, typically by a wet etch process, using hydrofluoric acid (HF) buffered with ammonium fluoride ($NH_4F$) as an illustrative etchant. Alternatively, the exposed regions of SOG layer 86 may be removed by a reactive ion etch (RIE) process using carbon tetraflouride ($CF_4$).

Figure 11A:
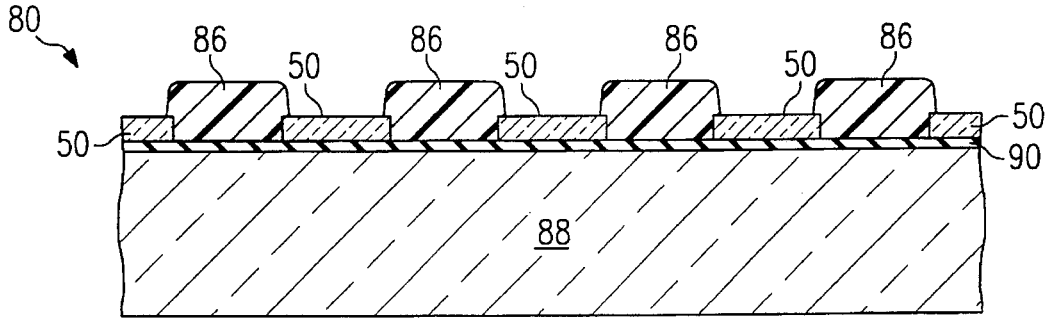
FIGS. 11A through 11B illustrate two sections of the anode plate at a fourth processing stage in accordance with the present invention.
Figure 11B:
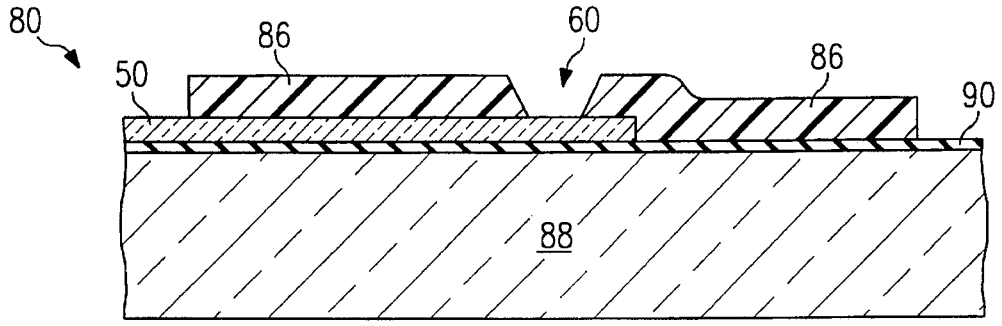

The remaining photoresist layer 94 may be removed by a wet strip process using acetone as the etchant; alternatively, layer 94 may be removed using a dry, oxygen plasma ash process. FIGS. 11A and 11B illustrate the structures at the current stage of the fabrication process. It is to be noted that the via 60 region of the ITO layer 50 is now exposed, as illustrated in FIG. 11B. Via 60 is approximately 50 microns in the present invention in order to facilitate a robust electrical connection between the anode stripes 50 and their buses 52, 54, or 56.

It is a technical advantage to deposit the dielectric insulator 86 in the bus region at the same time, and with the same material, as the opaque insulator used in the active area in the spaces between the anode stripes. First, by using the opaque insulator as the interlevel dielectric, the extra manufacturing step of depositing an interlevel dielectric in the bus region is eliminated. By eliminating the separate interlevel dielectric deposition step, the manufacturing cost of depositing a separate interlevel dielectric is eliminated, therefore the total cost of the anode plate is reduced. Furthermore, by eliminating the separate interlevel dielectric deposition step, potential manufacturing errors which may be induced during that step is avoided (i.e. damage to the glass and increases in defect density).

A second conductive layer, which comprises the bus structure, is formed by a deposition process (for example Al:2%Cu of a thickness of approximately 1 micron) over the entire anode plate. A layer of photoresist is spun over the AlCu layer, a patterned mask defining buses 52, 54, 56 (shown in FIG. 5) is then disposed over the light-sensitive photoresist layer. Next, the developing step removes the unwanted photoresist regions which were exposed to light. The exposed regions of the AlCu are then removed, typically using either plasma or wet chemistries, which do not harm the previously deposited metal ITO layer. The AlCu bus layer 52 is now electrically interconnected to anode stripe 50 in the via region 60 as a result of the DLM process described. The remaining photoresist layer is removed by a wet strip process using commercial organic strippers or plasma ashing. The completed DLM structure is shown in FIG. 7.

The final step in the fabrication process of the anode structure is to provide the cathodoluminescent phosphor coatings 84 (of FIG. 6), which are deposited over conductive ITO regions 50, typically by electrophoretic deposition. The phosphor coatings 84 could also be deposited by the slurry technique or the dusting technique. FIG. 6 shows the final structure after the deposition of the phosphor coatings.

Several other variations in the above processes, such as would be understood by one skilled in the art to which it pertains, are considered to be within the scope of the present invention. As a first such variation, it will be understood that glass layer 86 may be deposited by a technique other than those described above, for example sputter deposition.

According to another variation, SOG layer 86 may be dry etched, illustratively in a plasma reactor. It will also be recognized that a hard mask, such as aluminum or gold, may replace photoresist layers 92 and 94 of the above processes.

According to another variation, photosensitive glass materials are known, and it may be possible to pattern insulator layer 86 directly, without the use of photoresists. Furthermore, while the disclosure describes removing the opaque insulator 86 from the edge regions, which accommodates the later placement of display components on the anode plate 80, the opaque insulator may fully cover the area outside the bus region (interconnect portion), thereby reducing manufacturing costs. Furthermore, while the disclosure specifies the thickness of the described opaque layer as 15,000Å, a thinner layer of lesser-doped SOG may be used. Finally, while the disclosure describes a manufacturing process using positive photoresist, a manufacturing process employing negative photoresist is also comprehended.

A field emission flat panel display device, as disclosed herein, including the opaque insulator on the anode plate thereof, and the methods disclosed herein for preparing the opaque insulating material and for applying the material to the anode plate, overcome limitations and disadvantages of the prior art display devices and methods. The opaque, electrically insulating material of the present invention fills in the gaps between the stripe conductors of the anode, thereby acting as a barrier to the entry of ambient light into the device, and further preventing the re-emergence of light reflected from the active surface of emitter plate. In addition, by virtue of its electrical insulating quality, the opaque material serves to increase the electrical isolation of the stripe conductor from one another, thereby permitting the use of higher anode potentials without the risk of breakdown due to increased leakage current.

The use of an insulating material separating the stripe conductors of the anode also provides the advantage of improving the definition of the phosphor depositions. Finally, it is noted that the improved insulating qualities of the structure of the present invention will allow the use of narrower spacings between the stripe conductors of the anode, thereby allowing increased anode stripe widths and increasing the area coated by the phosphors.

The use of DLM technology, as disclosed herein improves the anode plate reliability by eliminating the use of the mechanically attached external bus strip. The use of the opaque insulator as the interlevel dielectric in the bus region provides the advantage of reducing the cost of the anode plate by eliminating the need for an extra manufacturing step to deposit the dielectric for the DLM bus structure. Hence, for the application to flat panel display devices envisioned herein, the approaches in accordance with the present invention provide significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A method of fabricating an anode plate for use in a field emission device, said method comprising the steps of:

providing a transparent substrate;

depositing a layer of a transparent, electrically conductive material on a surface of said substrate;

removing portions of said layer of conductive material to leave substantially parallel stripes of said conductive material; said electrically conductive regions having an image-forming portion and an interconnect portion;

providing a solution of an opaque, electrically insulating material;

coating said surface with said opaque solution;

removing said opaque material from said image-forming portion of said conductive regions and from selected areas of said interconnect portion of said conductive regions;

providing a first bus electrically connected to a first series of said conductive regions in said interconnect portion of said conductive regions;

providing a second bus electrically connected to a second series of said conductive regions in said interconnect portion of said conductive regions;

providing a third bus electrically connected to a third series of said conductive regions in said interconnect portion of said conductive regions;

applying luminescent material of a first color on said first series of conductive regions in said image-forming portion;

applying luminescent material of a second color on said second series of conductive regions in said image-forming portion; and applying luminescent material of a third color on said third series of conductive regions in said image-forming portion.

2. The method in accordance with claim 1 wherein said step of coating said surface with said opaque material comprises the steps of:

spinning the substrate; and dispensing said solution onto said surface to disperse said solution over said surface.

3. The method in accordance with claim 1 wherein said step of coating said surface with said opaque material comprises the step of spreading said solution onto said surface.

4. The method in accordance with claim 1 wherein said step of removing said opaque material from selected areas of said interconnect portion of said conductive regions comprises forming vias through said opaque material to said conductive regions.

5. The method in accordance with claim 1 wherein said step of coating said surface with said opaque solution comprises the steps of:

(a) spinning said substrate;

(b) dispensing said solution onto said surface to disperse said solution over said surface;

(c) heating said substrate so as to cure said opaque material; and (d) repeating said steps (a) through (c).

6. The method in accordance with claim 1 wherein said step of coating said surface with said opaque solution comprises the steps of:

(a) spreading said solution onto said surface (b) heating said substrate so as to cure said opaque material; and (c) repeating steps (a) through (b).

7. The method in accordance with claim 1 wherein said opaque, electrically insulating material comprises glass mixed with impurities which limit the transmissivity to visible light of said electrically insulating material to approximately three percent.

8. The method in accordance with claim 7 wherein said impurities include the oxide of a transition metal.

9. The method in accordance with claim 1 wherein said step of providing a solution of an opaque, electrically insulating material comprises the sub-steps of:

providing a solution of tetraethylorthosilicate (TEOS) and a solvent; and adding impurities to said TEOS solution which limit the transmissivity to visible light of said electrically insulating material.

10. The method in accordance with claim 9 wherein said step of adding impurities includes adding an organic dye to said TEOS solution.

11. The method in accordance with claim 9 wherein said step of adding impurities includes adding more than one organic dye, said dyes being selected to provide opacity over the spectrum of visible light.

12. The method in accordance with claim 9 wherein said step of adding impurities includes adding a compound of a transition metal to said TEOS solution.

13. The method in accordance with claim 12 wherein said transition metal is selected from the group including cobalt and copper.

14. The method in accordance with claim 12 wherein said compound comprises cobalt nitrate ($Co(NO_3)_2$).

15. The method in accordance with claim 14 further including the sub-step of adding butanol to said solution.

* * * * *